US008714550B2

(12) United States Patent
Frontiero, Jr.

(10) Patent No.: US 8,714,550 B2
(45) Date of Patent: May 6, 2014

(54) LED PINBALL MACHINE GRAPHICS DISPLAY

(76) Inventor: James J. Frontiero, Jr., Gloucester, MA (US)

( * ) Notice: Subject to any disclaimer, the term of this patent is extended or adjusted under 35 U.S.C. 154(b) by 771 days.

(21) Appl. No.: 12/618,062

(22) Filed: Nov. 13, 2009

(65) Prior Publication Data

US 2011/0115155 A1 May 19, 2011

(51) Int. Cl.
*A63D 3/02* (2006.01)

(52) U.S. Cl.
USPC ..... 273/121 A; 273/118 A; 273/118 R; 273/119 A; 273/121 R; 463/3; 463/7; 463/30

(58) Field of Classification Search
USPC ..... 273/121, 313, 54 C, 118 R, 118 A, 119, 273/119 A, 119 R, 121 A, 121 R; 463/5, 7, 463/16, 18, 30–31
See application file for complete search history.

(56) References Cited

U.S. PATENT DOCUMENTS

| | | | | | |
|---|---|---|---|---|---|
| 4,363,485 | A | * | 12/1982 | Edwall | 273/121 A |
| 4,375,286 | A | * | 3/1983 | Seitz et al. | 273/121 A |
| 5,149,094 | A | * | 9/1992 | Tastad | 273/121 A |
| 5,316,303 | A | | 5/1994 | Trudeau et al. | |
| 6,000,697 | A | * | 12/1999 | Popadiuk et al. | 273/118 R |
| 6,036,189 | A | | 3/2000 | Gomez et al. | |
| 6,164,644 | A | | 12/2000 | Cornell et al. | |
| 6,199,861 | B1 | | 3/2001 | Hume et al. | |

* cited by examiner

*Primary Examiner* — Sunit Pandya
(74) *Attorney, Agent, or Firm* — Daniel N. Smith

(57) ABSTRACT

The subject invention discloses an improved pinball machine and a method of updating existing pinball machines by replacing existing internal gas tube graphic displays with bright, large LED dot matrix or plasma dot matrix displays. These bright and large displays may be attached to a pinball machine within the backbox, external to the backbox or both. These large graphic displays contain multiple display circuit boards that can be separately removed and replaced devices for cheaper maintenance. This method allows any existing pinball machine to be updated with large, bright displays that can illuminate in a variety of colors with adjustable brightness.

11 Claims, 12 Drawing Sheets

LED PINBALL MACHINE GRAPHICS DISPLAY

FIELD OF THE INVENTION

The field of the invention relates to novel methods of updating existing pinball machines with large bright LED (Light Emitting Diode) dot matrix or plasma dot matrix displays that may be easily removed for maintenance.

BACKGROUND OF INVENTION

Pinball machines have graphic displays that are connected to machine processors to display scores, words, or other images before, during and after actual game play.

Existing displays on pinball machine are small and difficult to read, especially during game play. A player may become distracted trying to split his vision between game play on the playfield of the machine and the display on the vertical backbox of the machine. This may be disruptive to game play since the display may contain information important to the individual game, such as bonuses that may be available.

Previous solutions to increasing the visibility of pinball machine graphic displays included creating a new pinball machine with a display within the playfield (U.S. Pat. No. 6,000,697), a new pinball machine with a marquee at the top of two or more pinball machines (U.S. Pat. No. 5,890,715), or projecting video images onto a reflectable panel inserted into the playfield (U.S. Pat. No. 6,199,861).

None of these solutions could be easily retrofitted into existing pinball machines. Many pinball machines are becoming antiques and quite valuable. In addition, none of these previous solutions allowed for upgraded graphic displays to be easily removed for routine servicing.

Accordingly, a need exists for a method and apparatus for retrofitting existing pinball machines with readable displays that can be easily removed and replaced.

SUMMARY OF THE INVENTION

There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

One embodiment of the subject invention is a dot matrix graphics display assembly for a pinball machine, comprising: an enclosure including a pair of opposing side walls, a top wall and a bottom wall; a plurality of display modules that display images and at least one control board mounted within the enclosure, wherein the control board further comprises a means for interfacing the plurality of display modules and a means to interface a pinball machine control unit; a translucent panel mounted within the enclosure, wherein the translucent panel covers the plurality of display modules; and a means to connect the dot matrix graphics display assembly to a power supply of the pinball machine.

In a further embodiment of the subject invention, the display modules may comprise plasma dot matrix or LED dot matrix display modules. In another embodiment of the subject invention, each display module may comprise an 8-inch by 8-inch printed circuit board. In another embodiment of the subject invention, the display modules may comprise 128×32 LED or plasma graphics display with 128 columns and 32 rows of individual pixels. In another embodiment of the subject invention, the display modules may display colors selected from the group consisting of: red, yellow, orange, amber, green, blue and white. In one embodiment of the subject invention, the power supply may be adjustable to control the brightness of the display modules. In a further embodiment of the subject invention, the translucent panel may be tinted.

One embodiment of the subject invention is a pinball machine, comprising: a cabinet including a pair of opposing side walls, a front wall and a rear wall, wherein a playfield is mounted within the cabinet, further wherein the playfield supports a rolling ball and a plurality of play features thereon; a substantially vertical backbox on top of the rear wall of the cabinet, wherein the backbox comprises a substantially vertical front side facing a user of the pinball machine; an electronics system including a game control unit with means to interface a plurality of input/output elements mounted to the playfield, further wherein the game control unit comprises a software program that monitors game operation and monitors game play; a first external graphics display assembly externally attached to the backbox at the bottom of the front side, the first external graphics display assembly comprising a first plurality of display modules that display images to a user of the pinball machine and at least one first control board within a first enclosure, wherein the first control board comprises a first means for interfacing the first plurality of display modules and a first means to interface the game control unit, further wherein the first plurality of display modules are covered by a first translucent panel; and a power supply and a first means to connect the first graphics display assembly to the power supply.

In another embodiment of the subject invention, the pinball machine comprises a second external graphics display assembly externally attached on top of the backbox, the second external graphics display assembly comprising a second plurality of display modules that display images to a user of the pinball machine and at least one second control board within a second enclosure, wherein the second control board comprises a second means for interfacing the second plurality of display modules and a second means to interface the game control unit, further wherein the second plurality of display modules are covered by a second translucent panel; and a second means to connect the second graphics display assembly to the power supply.

In a further embodiment of the subject invention, the display modules may comprise plasma dot matrix or LED dot matrix display modules. In another embodiment of the subject invention, each display module may comprise an 8-inch by 8-inch printed circuit board. In another embodiment of the subject invention, the display modules may comprise 128×32 LED or plasma graphics display with 128 columns and 32 rows of individual pixels.

In another embodiment of the subject invention, the display modules may display colors selected from the group consisting of: red, yellow, orange, amber, green, blue and white.

In one embodiment of the subject invention, the power supply may be adjustable to control the brightness of the display modules.

In an additional embodiment of the subject invention, the first and second external graphics display assemblies may be removed from the pinball machine and serviced upon failure.

In another embodiment of the subject invention, an internal display of the pinball machine is removed before attaching the first external graphics display assembly to the backbox.

In a further embodiment of the subject invention, the first or second translucent panels may be tinted.

In another embodiment of the subject invention, the first or second pluralities of display modules are interconnected using two connectors on each side of each module.

One embodiment of the subject invention is a method of retrofitting a pinball machine, said pinball machine including a cabinet including a pair of opposing side walls, a front wall and a rear wall, wherein a playfield is mounted within the cabinet; a substantially vertical backbox on top of the rear wall of the cabinet, wherein the backbox comprises an internal display assembly covered by a first translucent panel facing a user of the pinball machine; an electronics system including a game control unit with means to interface a plurality of input/output elements mounted to the playfield, further wherein the game control unit comprises a software program that monitors game operation and monitors game play; means to interface the internal display assembly and the game control unit; and a power supply with a means to connect to the internal display assembly; the method comprising the steps of: removing the first translucent panel from the backbox; detaching the internal display assembly from the means to interface the game control unit and the means to connect to the power supply; removing the internal display from the backbox; installing means to externally attach a first external graphics display assembly to the backbox at the bottom of the front side, wherein the first external graphics display assembly comprises a first plurality of display modules and at least one first control board within a first enclosure, wherein the first control board comprises a first means for interfacing the first plurality of display modules, further wherein the first plurality of display modules are covered by a second translucent panel; attaching the means to interface the internal display assembly and the game control unit to the first control board of the first external graphics display; attaching the means to connect to the power supply to the first external graphics display; and attaching the first external graphics display assembly to the backbox at the bottom of the front side.

In another embodiment of the subject invention, the step of installing means to externally attach a first external graphics display assembly to the backbox at the bottom of the front side comprises attaching mounting brackets onto a display mounting panel square cutout from which the internal display assembly has been removed from the backbox.

An additional embodiment of the subject invention is a kit for retrofitting a pinball machine, said pinball machine including a cabinet including a pair of opposing side walls, a front wall and a rear wall, wherein a playfield is mounted within the cabinet; a substantially vertical backbox on top of the rear wall of the cabinet, wherein the backbox comprises an internal display assembly covered by a first translucent panel facing a user of the pinball machine; an electronics system including a game control unit with means to interface a plurality of input/output elements mounted to the playfield, further wherein the game control unit comprises a software program that monitors game operation and monitors game play; means to interface the internal display assembly and the game control unit; and a power supply with a means to connect to the internal display assembly; the method comprising the steps of: removing the first translucent panel from the backbox; detaching the internal display assembly from the means to interface the game control unit and the means to connect to the power supply; removing the internal display from the backbox; installing means to externally attach a first external graphics display assembly to the backbox at the bottom of the front side, wherein the first external graphics display assembly comprises a first plurality of display modules and at least one first control board within a first enclosure, wherein the first control board comprises a first means for interfacing the first plurality of display modules, further wherein the first plurality of display modules are covered by a second translucent panel; attaching the means to interface the internal display assembly and the game control unit to the first control board of the first external graphics display; attaching the means to connect to the power supply to the first external graphics display; and attaching the first external graphics display assembly to the backbox at the bottom of the front side.

A further embodiment of the subject invention is a method of retrofitting a pinball machine, said pinball machine including a cabinet including a pair of opposing side walls, a front wall and a rear wall, wherein a playfield is mounted within the cabinet; a substantially vertical backbox on top of the rear wall of the cabinet, wherein the backbox comprises an internal display assembly covered by a first translucent panel facing a user of the pinball machine; an electronics system including a game control unit with means to interface a plurality of input/output elements mounted to the playfield, further wherein the game control unit comprises a software program that monitors game operation and monitors game play; means to interface the internal display assembly and the game control unit; and a power supply with a means to connect to the internal display assembly; the method comprising the steps of: removing the first translucent panel from the backbox; detaching the internal display assembly from the means to interface the game control unit and the means to connect to the power supply; removing the internal display from the backbox; installing means to externally attach a first external graphics display assembly to the backbox at the bottom of the front side, wherein the first external graphics display assembly comprises a first plurality of display modules and at least one first control board within a first enclosure, wherein the first control board comprises a first means for interfacing the first plurality of display modules, further wherein the first plurality of display modules are covered by a second translucent panel; installing means to externally attach a second external graphics display assembly to the backbox at top, wherein the second external graphics display assembly comprises a second plurality of display modules and at least one second control board within a second enclosure, wherein the second control board comprises a second means for interfacing the second plurality of display modules, further wherein the second plurality of display modules are covered by a third translucent panel; installing an interface board to the means to interface the internal display assembly and the game control unit, wherein the interface board splits games signals from the game control unit to a first means to interface the first external graphics display assembly and a second means to interface the second external graphics display assembly; attaching the first means to interface the first external graphics display assembly to the first control board of the first external graphics display; attaching the second means to interface the second external graphics display assembly to the second control board of the second external graphics display; attaching the means to connect to the power supply to the first external graphics display and the second external graphics display; attaching the first external graphics display assembly to the backbox at the bottom of the front side; and attaching the second external graphics display assembly to the top of the backbox.

Another embodiment of the subject invention is a kit for retrofitting a pinball machine, said pinball machine including a cabinet including a pair of opposing side walls, a front wall and a rear wall, wherein a playfield is mounted within the cabinet; a substantially vertical backbox on top of the rear wall of the cabinet, wherein the backbox comprises an internal display assembly covered by a first translucent panel facing a user of the pinball machine; an electronics system including a game control unit with means to interface a plurality of input/output elements mounted to the playfield, further wherein the game control unit comprises a software program that monitors game operation and monitors game play; means to interface the internal display assembly and the game control unit; and a power supply with a means to connect to the internal display assembly; the method comprising the steps of: removing the first translucent panel from the backbox; detaching the internal display assembly from the means to interface the game control unit and the means to connect to the power supply; removing the internal display from the backbox; installing means to externally attach a first external graphics display assembly to the backbox at the bottom of the front side, wherein the first external graphics display assembly comprises a first plurality of display modules and at least one first control board within a first enclosure, wherein the first control board comprises a first means for interfacing the first plurality of display modules, further wherein the first plurality of display modules are covered by a second translucent panel; installing means to externally attach a second external graphics display assembly to the backbox at top, wherein the second external graphics display assembly comprises a second plurality of display modules and at least one second control board within a second enclosure, wherein the second control board comprises a second means for interfacing the second plurality of display modules, further wherein the second plurality of display modules are covered by a third translucent panel; installing an interface board to the means to interface the internal display assembly and the game control unit, wherein the interface board splits games signals from the game control unit to a first means to interface the first external graphics display assembly and a second means to interface the second external graphics display assembly; attaching the first means to interface the first external graphics display assembly to the first control board of the first external graphics display; attaching the second means to interface the second external graphics display assembly to the second control board of the second external graphics display; attaching the means to connect to the power supply to the first external graphics display and the second external graphics display; attaching the first external graphics display assembly to the backbox at the bottom of the front side; and attaching the second external graphics display assembly to the top of the backbox.

Another embodiment of the subject invention is a pinball machine comprising: a cabinet including a pair of opposing side walls, a front wall and a rear wall, wherein a playfield is mounted within the cabinet, further wherein the playfield supports a rolling ball and a plurality of play features thereon; a substantially vertical backbox on top of the rear wall of the cabinet, wherein the backbox comprises a substantially vertical front side facing a user of the pinball machine; an electronics system including a game control unit with means to interface a plurality of input/output elements mounted to the playfield, further wherein the game control unit comprises a software program that monitors game operation and monitors game play; a first dot matrix graphics display assembly mounted within the backbox at the bottom of the front side, the first dot matrix graphics display assembly comprising a first plurality of display modules that display images to a user of the pinball machine and at least one first control board, wherein the first control board comprises a first means for interfacing the first plurality of display modules and a first means to interface the game control unit, further wherein the first plurality of display modules are covered by a first translucent panel; and a power supply and a first means to connect the first graphics display assembly to the power supply.

In a further embodiment of the subject application, the pinball machine further comprises a second dot matrix graphics display assembly externally attached on top of the backbox, the second dot matrix graphics display assembly comprising a second plurality of display modules that display images to a user of the pinball machine and at least one second control board within an enclosure, wherein the second control board comprises a second means for interfacing the second plurality of display modules and a second means to interface the game control unit, further wherein the second plurality of display modules are covered by a second translucent panel; and a second means to connect the second dot matrix graphics display assembly to the power supply.

In a further embodiment of the subject invention, the display modules may comprise plasma dot matrix or LED dot matrix display modules. In another embodiment of the subject invention, each display module may comprise an 8-inch by 8-inch printed circuit board. In another embodiment of the subject invention, the display modules may comprise 128×32 LED or plasma graphics display with 128 columns and 32 rows of individual pixels. In another embodiment of the subject invention, the display modules may display colors selected from the group consisting of: red, yellow, orange, amber, green, blue and white. In one embodiment of the subject invention, the power supply may be adjustable to control the brightness of the display modules.

In an additional embodiment of the subject invention, the first and second dot matrix graphics display assemblies may be removed from the pinball machine and serviced upon failure.

In a further embodiment of the subject invention, the first or second translucent panels may be tinted.

Another embodiment of the subject invention is a pinball machine, comprising: a cabinet including a pair of opposing side walls, a front wall and a rear wall, wherein a playfield is mounted within the cabinet, further wherein the playfield supports a rolling ball and a plurality of play features thereon; a substantially vertical backbox on top of the rear wall of the cabinet, wherein the backbox comprises a substantially vertical front side facing a user of the pinball machine; an electronics system including a game control unit with means to interface a plurality of input/output elements mounted to the playfield, further wherein the game control unit comprises a software program that monitors game operation and monitors game play; a first external graphics display assembly externally attached to the top of the backbox, the first external graphics display assembly comprising a first plurality of display modules that display images to a user of the pinball machine and at least one first control board within a first enclosure, wherein the first control board comprises a first means for interfacing the first plurality of display modules and a first means to interface the game control unit, further wherein the first plurality of display modules are covered by a first translucent panel; and a power supply and a first means to connect the first graphics display assembly to the power supply.

In a further embodiment of the subject invention, the display modules may comprise plasma dot matrix or LED dot matrix display modules. In another embodiment of the subject invention, each display module may comprise an 8-inch by 8-inch printed circuit board. In another embodiment of the subject invention, the display modules may comprise 128×32 LED or plasma graphics display with 128 columns and 32 rows of individual pixels. In another embodiment of the subject invention, the display modules may display colors selected from the group consisting of: red, yellow, orange, amber, green, blue and white. In one embodiment of the subject invention, the power supply may be adjustable to control the brightness of the display modules.

In an additional embodiment of the subject invention, the first external graphics display assembly may be removed from the pinball machine and serviced upon failure. In a further embodiment of the subject invention, the first translucent panel may be tinted.

Another embodiment of the subject invention is a method of retrofitting a pinball machine, said pinball machine including a cabinet including a pair of opposing side walls, a front wall and a rear wall, wherein a playfield is mounted within the cabinet; a substantially vertical backbox on top of the rear wall of the cabinet, wherein the backbox comprises an internal display assembly covered by a first translucent panel facing a user of the pinball machine; an electronics system including a game control unit with means to interface a plurality of input/output elements mounted to the playfield, further wherein the game control unit comprises a software program that monitors game operation and monitors game play; means to interface the internal display assembly and the game control unit; and a power supply with a means to connect to the internal display assembly; the method comprising the steps of: attaching an external graphics display assembly to the top of the backbox, the external graphics display assembly comprising a plurality of display modules that display images to a user of the pinball machine and at least one control board within an enclosure, further wherein the first plurality of display modules are covered by a second translucent panel attaching a means for interfacing the plurality of display modules to the control board; attaching a means to interface the internal display assembly to the control board; attaching a means to interface the game control unit to the control board; and attaching the external graphics display assembly to the power supply.

A further embodiment of the subject invention is a kit for retrofitting a pinball machine, said pinball machine including a cabinet including a pair of opposing side walls, a front wall and a rear wall, wherein a playfield is mounted within the cabinet; a substantially vertical backbox on top of the rear wall of the cabinet, wherein the backbox comprises an internal display assembly covered by a first translucent panel facing a user of the pinball machine; an electronics system including a game control unit with means to interface a plurality of input/output elements mounted to the playfield, further wherein the game control unit comprises a software program that monitors game operation and monitors game play; means to interface the internal display assembly and the game control unit; and a power supply with a means to connect to the internal display assembly; the method comprising the steps of: attaching an external graphics display assembly to the top of the backbox, the external graphics display assembly comprising a plurality of display modules that display images to a user of the pinball machine and at least one control board within an enclosure, further wherein the first plurality of display modules are covered by a second translucent panel attaching a means for interfacing the plurality of display modules to the control board; attaching a means to interface the internal display assembly to the control board; attaching a means to interface the game control unit to the control board; and attaching the external graphics display assembly to the power supply.

Another embodiment of the subject invention is a method of retrofitting a pinball machine, said pinball machine including a cabinet including a pair of opposing side walls, a front wall and a rear wall, wherein a playfield is mounted within the cabinet; a substantially vertical backbox on top of the rear wall of the cabinet, wherein the backbox comprises an internal display assembly covered by a first translucent panel facing a user of the pinball machine; an electronics system including a game control unit with means to interface a plurality of input/output elements mounted to the playfield, further wherein the game control unit comprises a software program that monitors game operation and monitors game play; means to interface the internal display assembly and the game control unit; and a power supply with a means to connect to the internal display assembly; the method comprising the steps of: removing the first translucent panel from the backbox; detaching the internal display assembly from the means to interface the game control unit and the means to connect to the power supply; removing the internal display assembly from the backbox; installing means to internally attach a dot matrix graphics display assembly within the backbox at the bottom of the front side, wherein the dot matrix graphics display assembly comprises a first plurality of display modules and at least one first control board, wherein the first control board comprises a first means for interfacing the first plurality of display modules, further wherein the first plurality of display modules are covered by a second translucent panel; attaching the means to interface the internal display assembly and the game control unit to the first control board of the dot matrix graphics display assembly; attaching the means to connect to the power supply to the dot matrix graphics display; and mounting the dot matrix graphics display assembly within the backbox at the bottom of the front side.

In a further embodiment of the subject invention, the step of installing means to internally attach a dot matrix graphics display assembly within the backbox at the bottom of the front side comprises attaching mounting brackets onto a display mounting panel square cutout from which the internal display assembly has been removed from the backbox.

In a further embodiment of the subject invention, the display modules may comprise plasma dot matrix or LED dot matrix display modules. In another embodiment of the subject invention, each display module may comprise an 8-inch by 8-inch printed circuit board. In another embodiment of the subject invention, the display modules may comprise 128×32 LED or plasma graphics display with 128 columns and 32 rows of individual pixels. In another embodiment of the subject invention, the display modules may display colors selected from the group consisting of: red, yellow, orange, amber, green, blue and white. In one embodiment of the subject invention, the power supply may be adjustable to control the brightness of the display modules. In a further embodiment of the subject invention, the first translucent panel may be tinted.

There has thus been broadly outlined important features of the invention in order that the detailed description thereof that follows may be better understood, and in order that the present contribution to the art may be better appreciated. There are additional features of the invention that will be described hereinafter and which will form the subject matter of the claims appended hereto. These together with other embodiments of the invention, and with various features of novelty which characterize the invention, are pointed out with particularity in the claims annexed to and formed as part of this disclosure.

For a conceptual understanding of the invention and its operational advantages, refer to the accompanying drawings and descriptive matter in which there are embodiments of the invention illustrated. Other features and advantages of the present invention will become apparent from the following description of the embodiment(s), taken in conjunction with the accompanying drawings, which by way of example; illustrate the principles of the invention.

BRIEF DESCRIPTION OF THE DRAWINGS

Advantages of the present invention will be apparent from the following detailed description of embodiments thereof, which description should be considered in conjunction with the accompanying drawings.

DETAILED DESCRIPTION OF EMBODIMENTS

The following will describe, in detail, several embodiments of the present invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used and made without departing from the scope and spirit of the invention.

Figure 1:
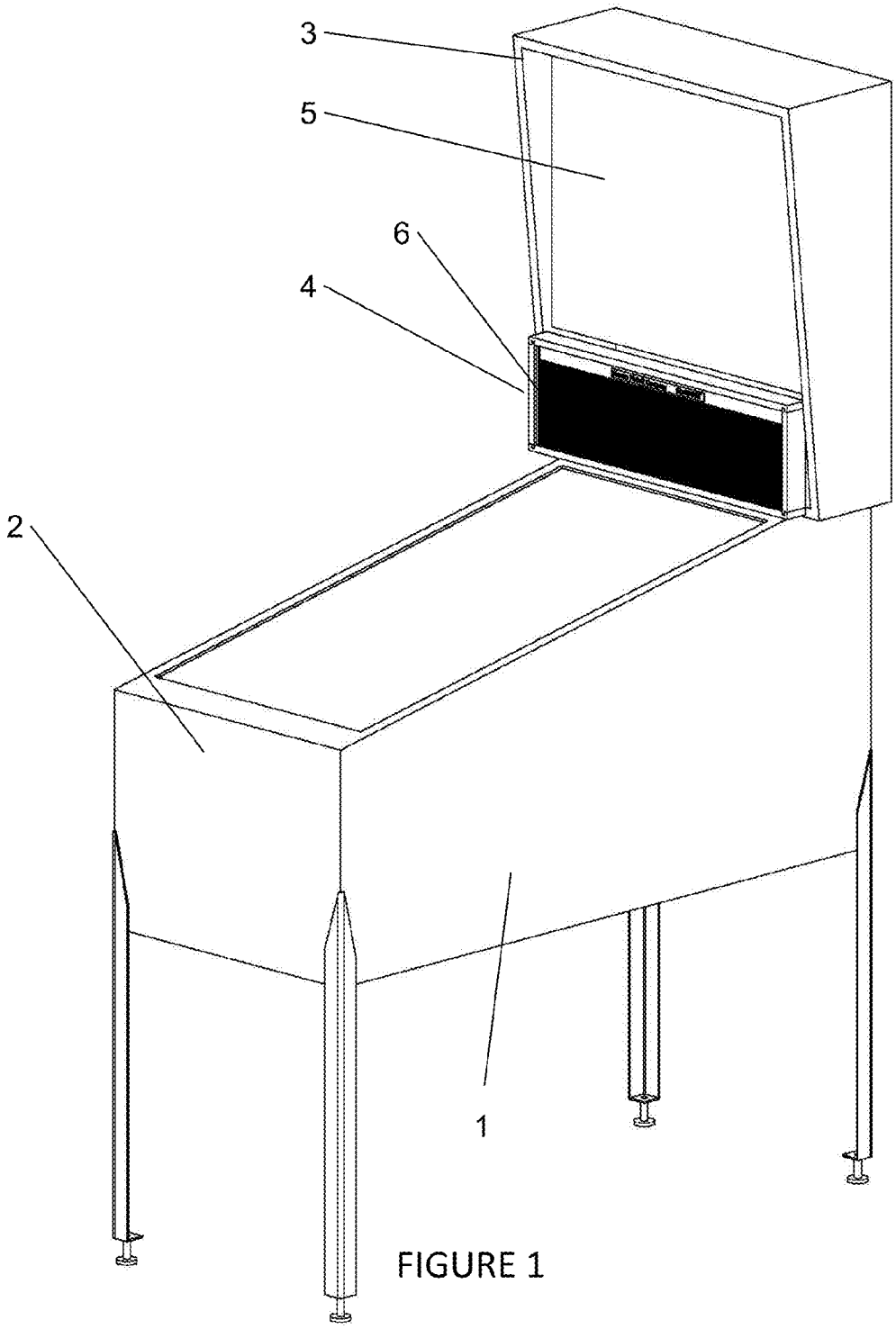
FIG. 1 illustrates an isometric view of the external GiantDOTS™ graphics display assembly attached to the front of a pinball machine backbox.

As shown in FIG. 1, one embodiment of the subject invention is an external GiantDOTS™ graphics display assembly 4 attached to the front of a backbox 3 of a pinball machine 1. The pinball machine contains a cabinet 2 with a playfield mounted therein (not shown). The playfield is a planar surface that usually inclines upwards from a player's position to the far end of the cabinet 2, near the backbox 3.

During game play on the pinball machine, a rolling ferromagnetic ball is propelled onto the playfield by manipulating a plunger (a spring-loaded rod) or a solenoid to strike and push the rolling ball onto the playfield (not shown). The playfield contains a plurality of play features activated during game play, including, but limited to lights, bumpers, kickers, slingshots, ramps, holes, saucers, various targets, gates, switches, toys and other rolling balls (not shown). Due to the incline of the playfield and the force of gravity, the rolling ball tends to roll downwards towards the player. A player may use one or more flippers (small levers) to strike the rolling ball on the playfield (not shown).

A vertical backbox 3 extends upward from a rear portion of the cabinet 2 and houses a game controller and other electronics for controlling play of the game. A backglass 5 on the front of the backbox 3 faces a player during game play.

The external GiantDOTS™ graphics display assembly 4 is attached to the front of the backbox 3 such that the display modules 6 face a player during game play. This external GiantDOTS™ graphics display assembly 4 replaces the internal dot-matrix display 7 (Shown in FIG. 2). This external GiantDOTS™ graphics display assembly 4 is controlled by the game controller's software program to project multiple images to a player during game play, including but not limited to: game score, balls remaining, animations, text and other graphics.

Figure 2:
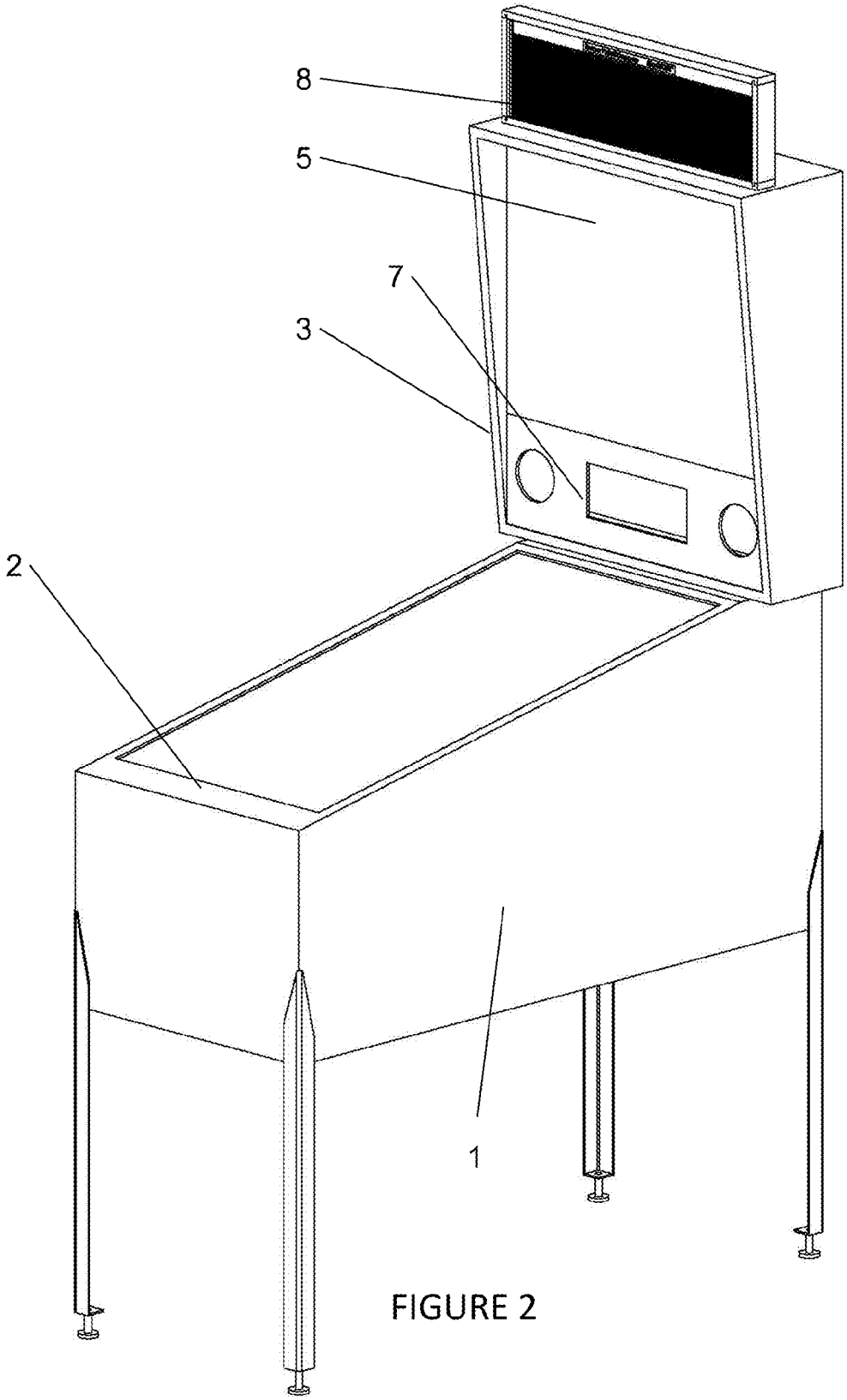
FIG. 2 illustrates an isometric view of the external GiantDOTS™ graphics display assembly attached to the top of a pinball machine backbox.
Figure 3:
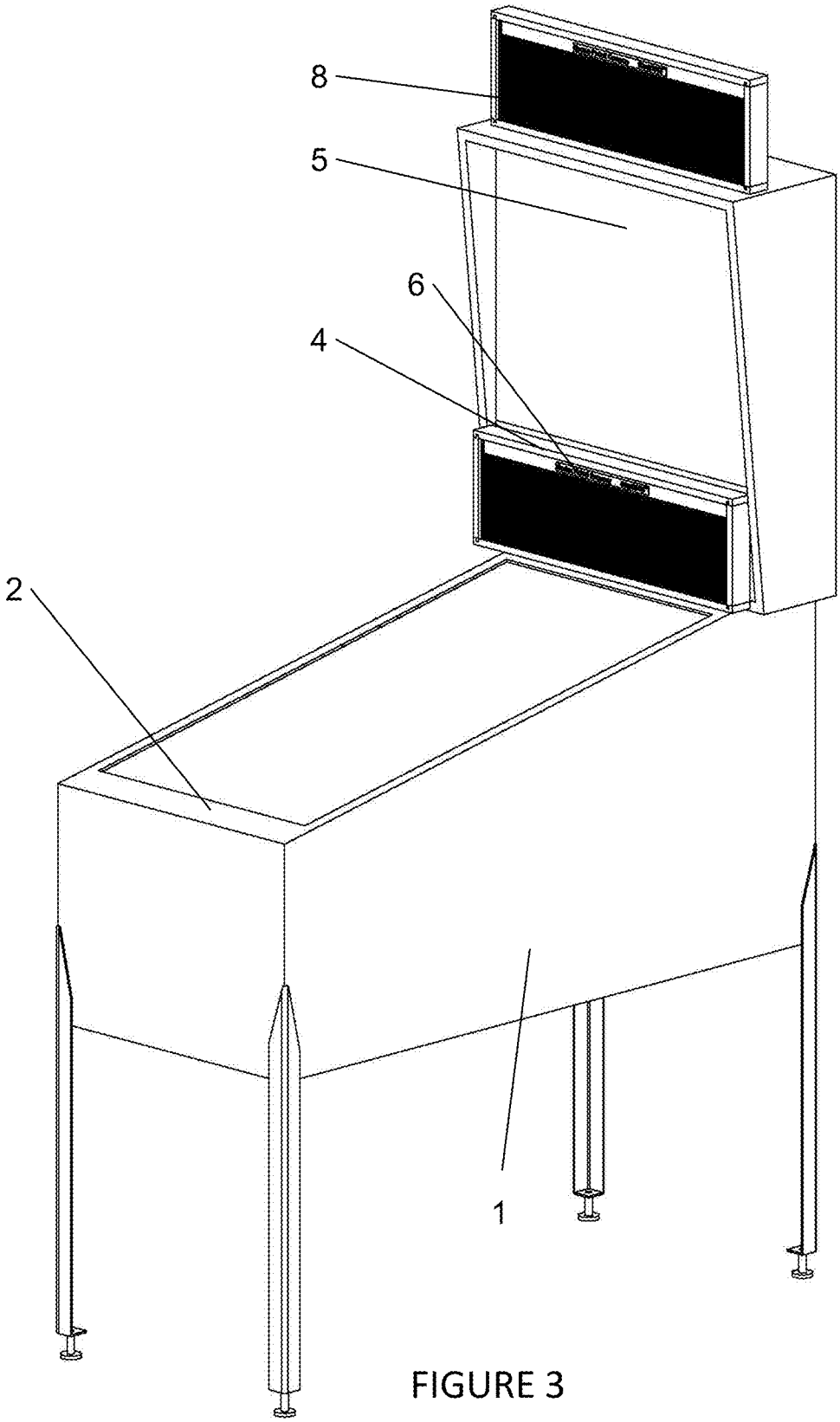
FIG. 3 illustrates an isometric view of two external GiantDOTS™ graphics display assemblies attached to the front of and top of a pinball machine backbox.
Figure 4:
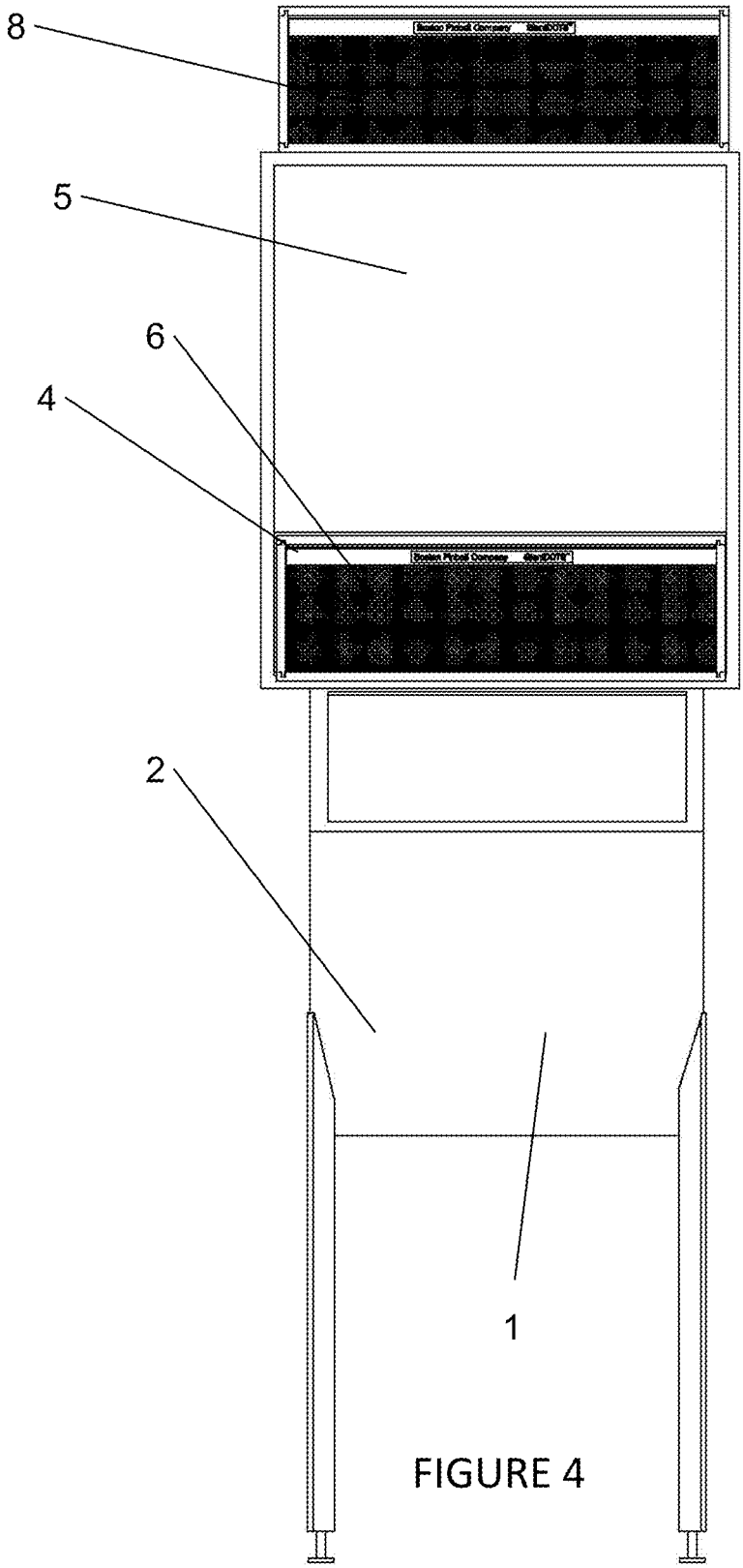
FIG. 4 illustrates a front view of two external GiantDOTS™ graphics display assemblies attached to the front of and top of a pinball machine backbox.
Figure 5:
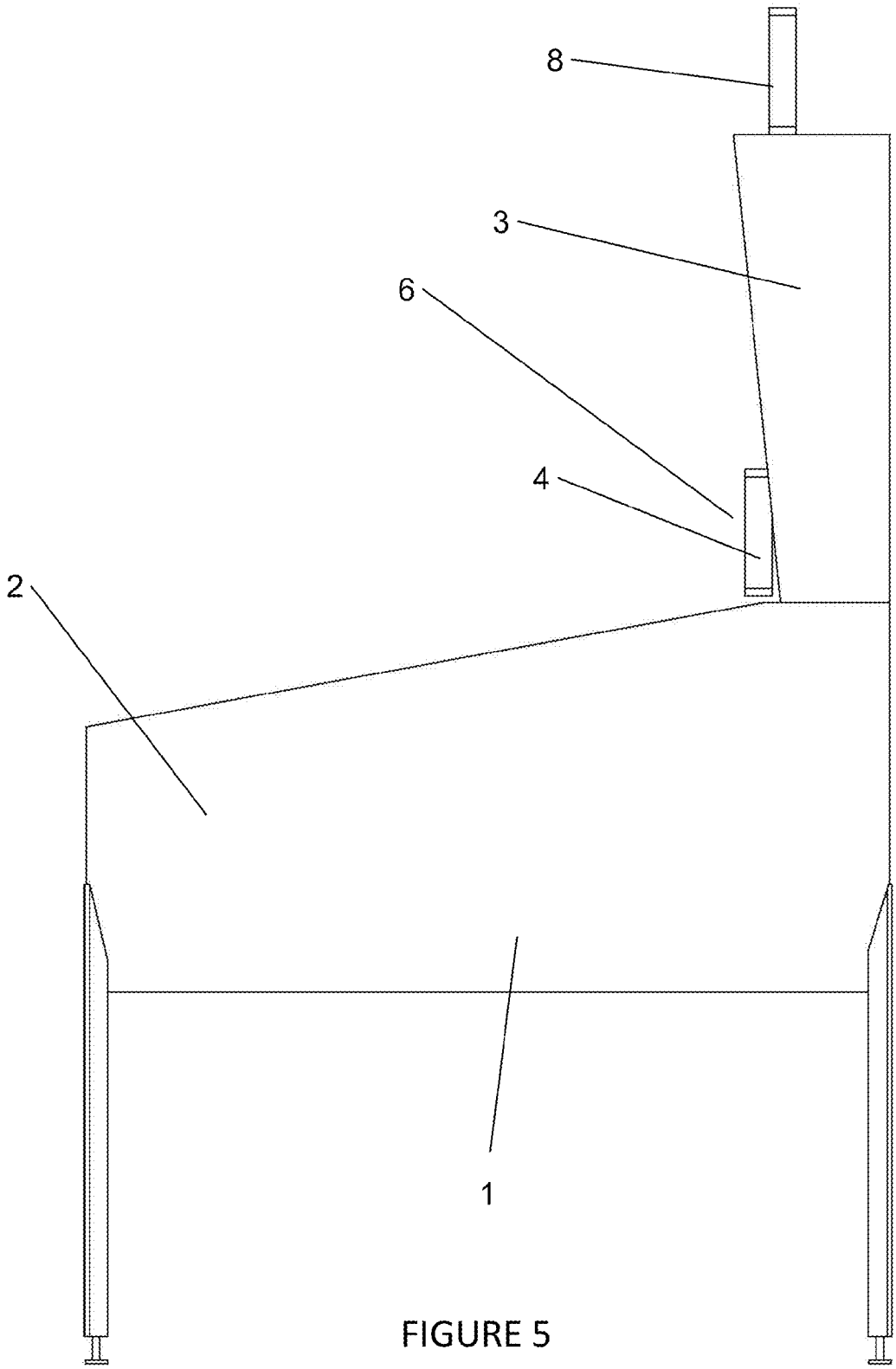
FIG. 5 illustrates a side view of two external GiantDOTS™ graphics display assemblies attached to the front of and top of a pinball machine backbox.
Figure 6:
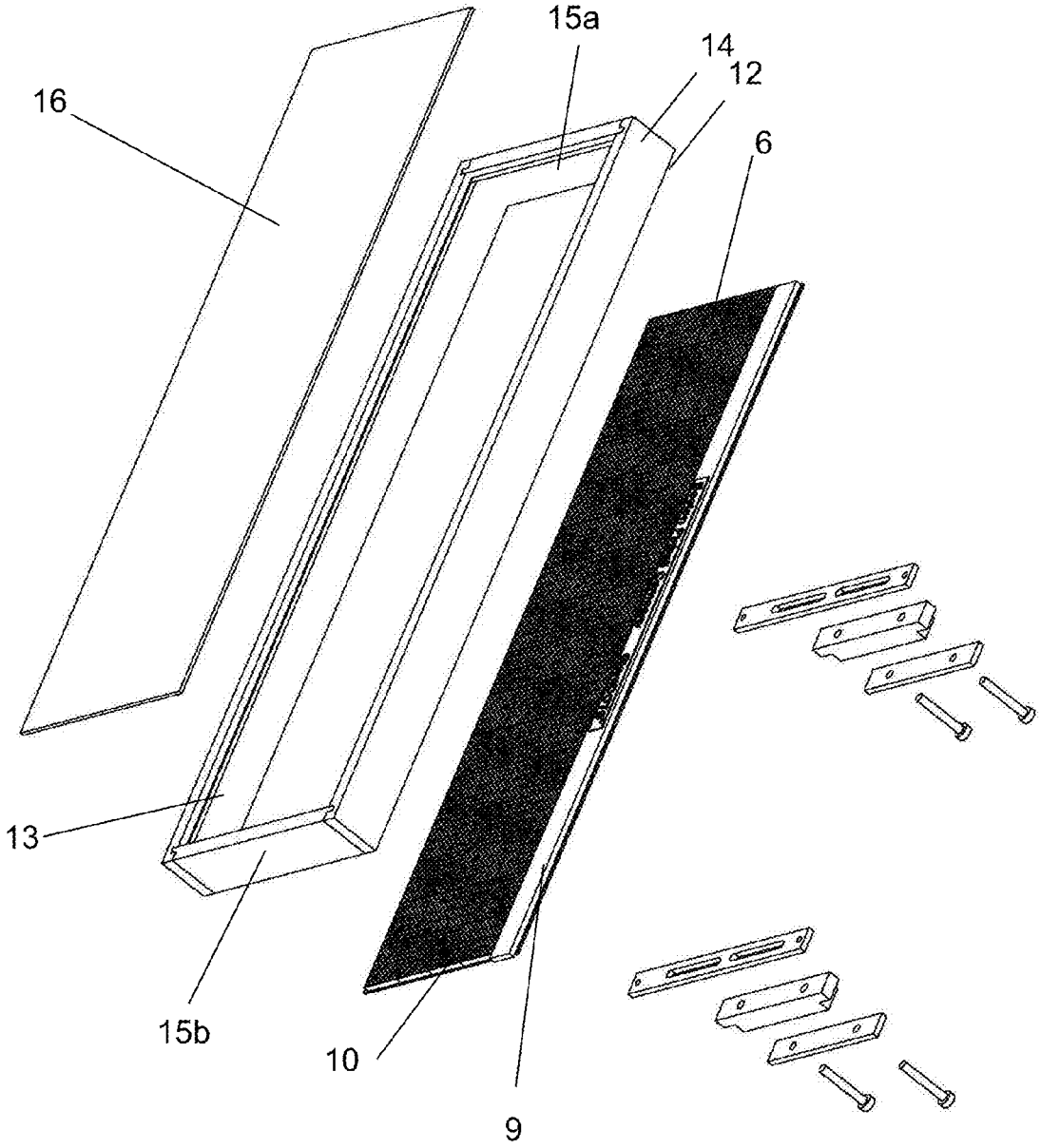
FIG. 6 illustrates an exploded front view of the external GiantDOTS™ graphics display assembly.
Figure 7:
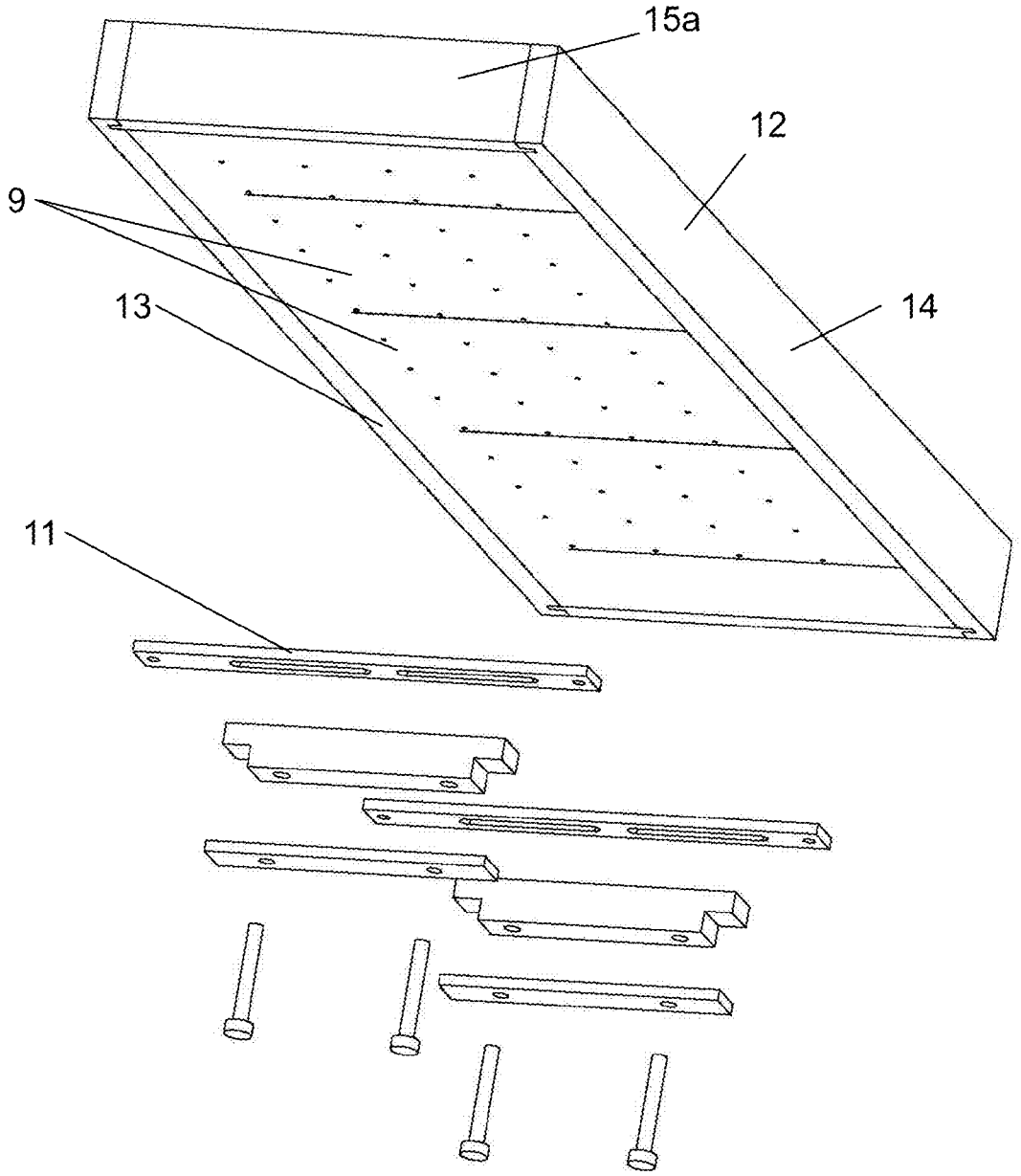
FIG. 7 illustrates an exploded back view of the mounting system of the external GiantDOTS™ graphics display assembly.
Figure 8:
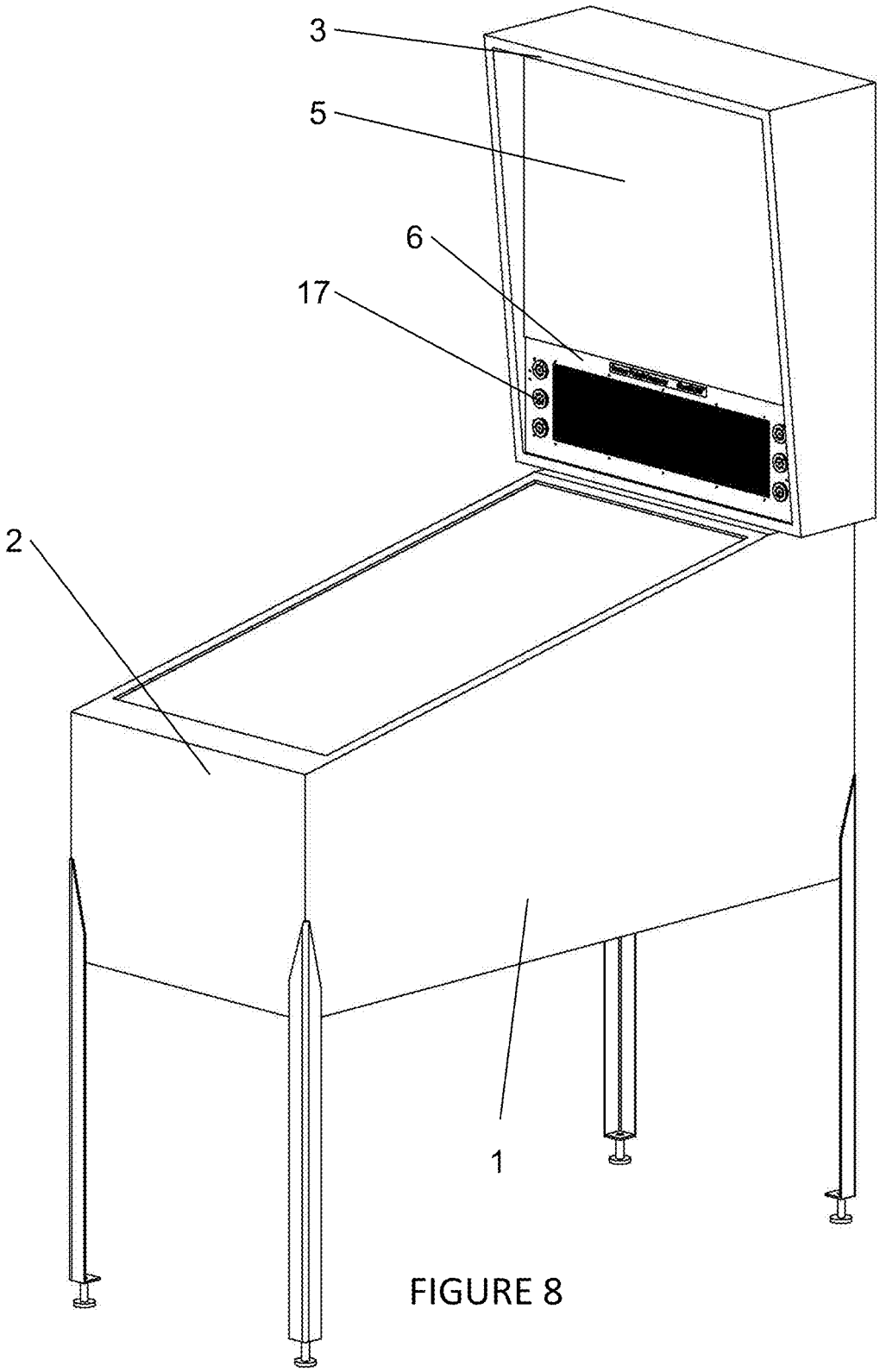
FIG. 8 illustrates an isometric front view of the internal GiantDOTS™ graphics display and speaker assembly inserted into the backbox of the pinball machine to replace a standard pinball machine gas tube display.

As shown in FIG. 2, an external GiantDOTS™ graphics display assembly 8 may also be placed on top of the pinball machine backbox 3 and the existing internal dot-matrix display 7 retained. In an alternative embodiment, shown in FIGS. 3-5, two external GiantDOTS™ graphics display assemblies 4 and 8 may be attached to the front of and top of a pinball machine backbox 3.

The top external GiantDOTS™ graphics display assembly 8 allows non-playing spectators of a game to easily observe the scores and graphics of a game being played from a distance. Such easy observation from spectators is beneficial for keeping scores in official pinball tournaments and for advertising.

The external GiantDOTS™ graphics display assemblies 4 and 8 contains several Light-Emitting Diode (LED) or plasma display modules 6 that project images to a player. In embodiments of the subject invention, display modules 6 are plasma or LED dot matrix printed circuit boards that may have a length of two to forty inches and a width of two to twenty inches. In one embodiment of the subject invention, these display modules 6 may be plasma or LED dot matrix-Eight-inch by Eight-inch printed circuit boards 9. These display modules 6 may each contain One Hundred Twenty-Eight columns and Thirty-Two rows of individual illuminating pixels 10. Since the display modules 6 are composed of LEDs, they may project images in the colors of red, yellow, orange, amber, green, blue and white.

In embodiments of the subject invention, the display modules 6 may contain one to ten printed circuit boards 9 connected by connectors (not shown). In one embodiment of the subject invention, the external GiantDOTS™ graphics display assembly 4 is comprised of four display module printed circuit boards 9 connected by four connectors on each display module 6. Each display module 6 has two connectors on each side. These connectors are used to interconnect the control wiring; power wiring and mechanical attach the display modules 6 together to provide alignment.

An individual display module printed circuit board 9 may be removed and replaced if it contains a broken or non-functioning pixel 10. Since the external GiantDOTS™ graphics display assembly 4 may be easily removed from the pinball machine 1 and the display modules 6 replaced individually, as needed, the maintenance costs for these displays are significantly reduced over the cost of repairing an internal plasma dot-matrix display 7 (which requires the entire display to be replaced).

The external GiantDOTS™ graphics display assembly 4 further contains a control board (not shown) that controls the operation of display modules 6 and connects the display modules 6 to the game controller of the pinball machine 1. The control board has provisions for several standoffs that align the control board with the display modules 6 to provide a secondary method of mechanical fit between them. Electrical interconnection between the control board and the display modules 6 is established by power interconnect cables and ribbon cables to provide the control signals from the game controller.

The display modules 6 and the control board are contained within an enclosure or box 12. In one embodiment of the subject invention, this enclosure 12 may be twenty to thirty inches in length. In a further embodiment of the subject invention, the enclosure 12 may be four to ten inches in height. In another embodiment of the subject invention, the enclosure 12 comprises a bottom piece 13, a top piece 14, and two side pieces 15*a* and 15*b*.

The imaging side of the display modules 6 facing the player during game play is covered by an acrylic, or other translucent material, panel 16. In one embodiment of the subject invention, the panel 16 may be twenty to thirty inches in length. In a further embodiment of the subject invention, the panel 16 may be four to ten inches in height. The panel 16 may be tinted to increase the visual aesthetics of graphic displays during game play.

The external GiantDOTS™ graphics display 4 has an adjustable power supply knob (not shown) that may be adjusted to control the brightness of the display modules 6.

Installation of the external GiantDOTS™ graphics display assembly 4 first requires the removal of an acrylic panel in front of an internal gas tube display 7 on a pinball machine 1. (Some pinball machines don't have this acrylic panel in front of the existing internal gas tube display, so this step may not be required.) This acrylic panel is removed by first removing the existing back glass 5 on the backbox 3. Once the back glass 5 is removed; the lower display panel where the existing internal gas tube display 7 is located and the internal gas tube display 7 are removed.

Once this acrylic panel and the internal gas tube display 7 are removed, interlocking brackets 11 used to support and attach the external GiantDOTS™ graphics display assembly 4 to the existing display mounting panel can be installed on the pinball machine 1. These brackets 11 are attached into the display mounting panel square cutout where the internal gas tube display 7 was previous located. Once the brackets are installed, the existing control and power cables of the pinball machine 1 can be attached to the external GiantDOTS™ graphics display assembly 4. Once this is done, the external GiantDOTS™ graphics display assembly 4 and the mounting panel can be re-installed onto the pinball machine 1.

For the external GiantDOTS™ graphics display assembly 8 to be located in a remote location, such as the top of the pinball machine as shown in FIG. 2, the control board must be connected to an additional interface printed circuit board (not shown). This interface printed circuit board is used to split the interface signals from the pinball machine game controller. This interface board contains a buffer circuit that allows the splitting of the signals and to provide isolation between the pinball machine circuitry and the remotely located external GiantDOTS™ graphics display assembly 8. The interface board and the external GiantDOTS™ graphics display assembly are connected with a cable for this purpose.

FIGS. 8-12 illustrate another embodiment of the subject invention, an internal GiantDOTS™ graphics display and speaker assembly 17.

Figure 9:
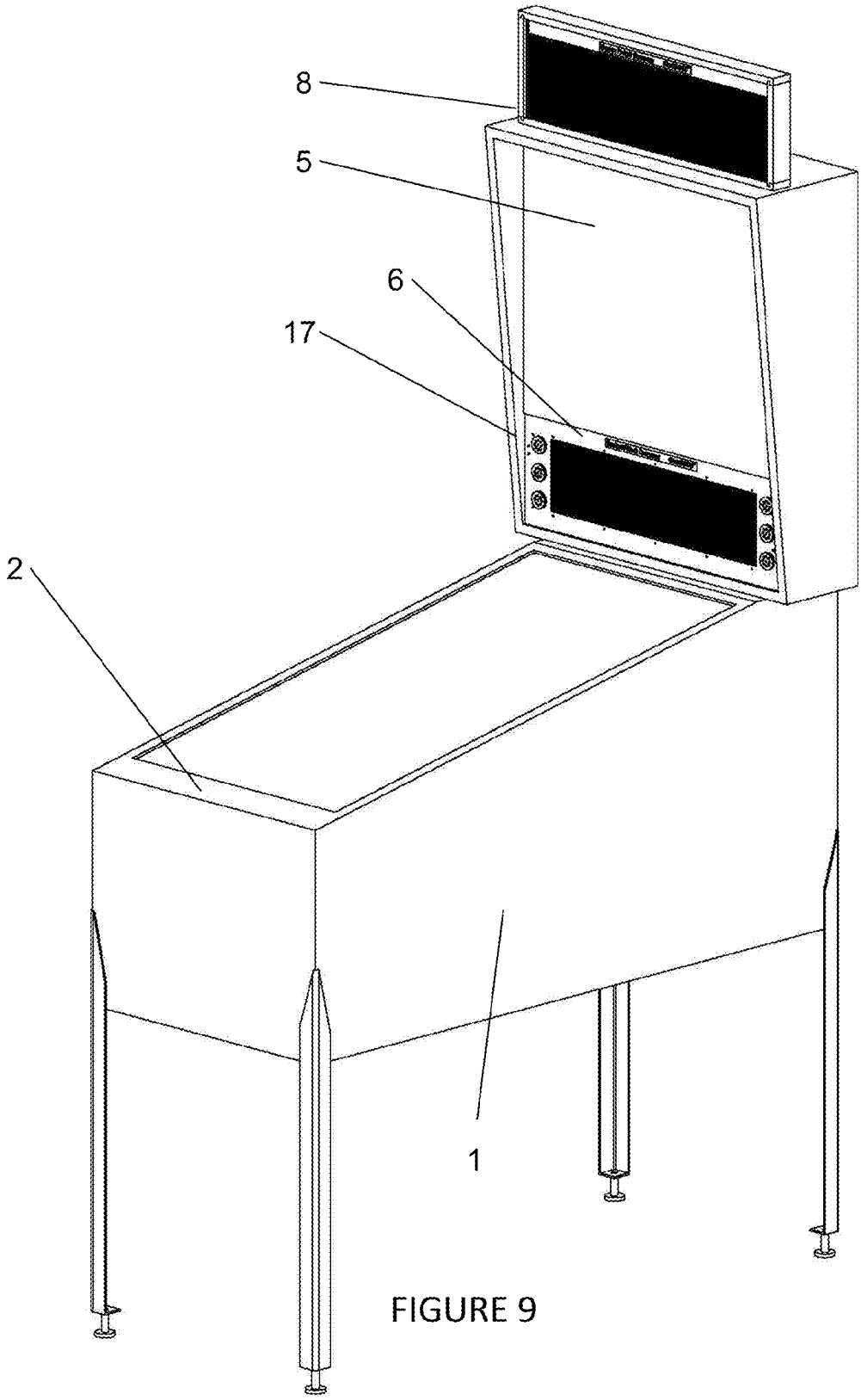
FIG. 9 illustrates an isometric front view of the internal GiantDOTS™ graphics display and speaker assembly inserted into the backbox of the pinball machine to replace a standard pinball machine gas tube display and an external GiantDOTS™ graphics display attached to the top of the backbox.
Figure 10:
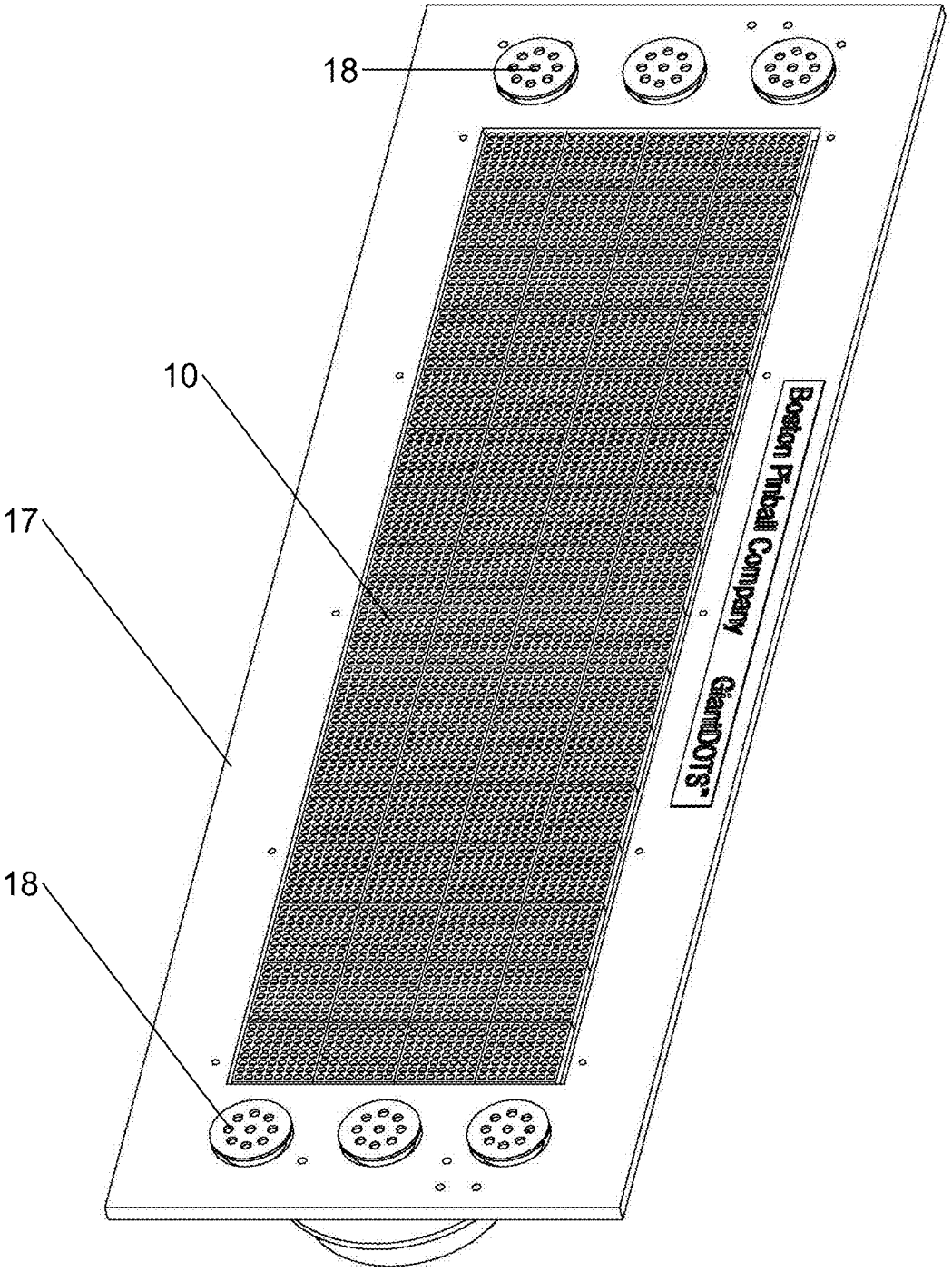
FIG. 10 illustrates a front view of the internal GiantDOTS™ graphics display and speaker assembly.
Figure 11:
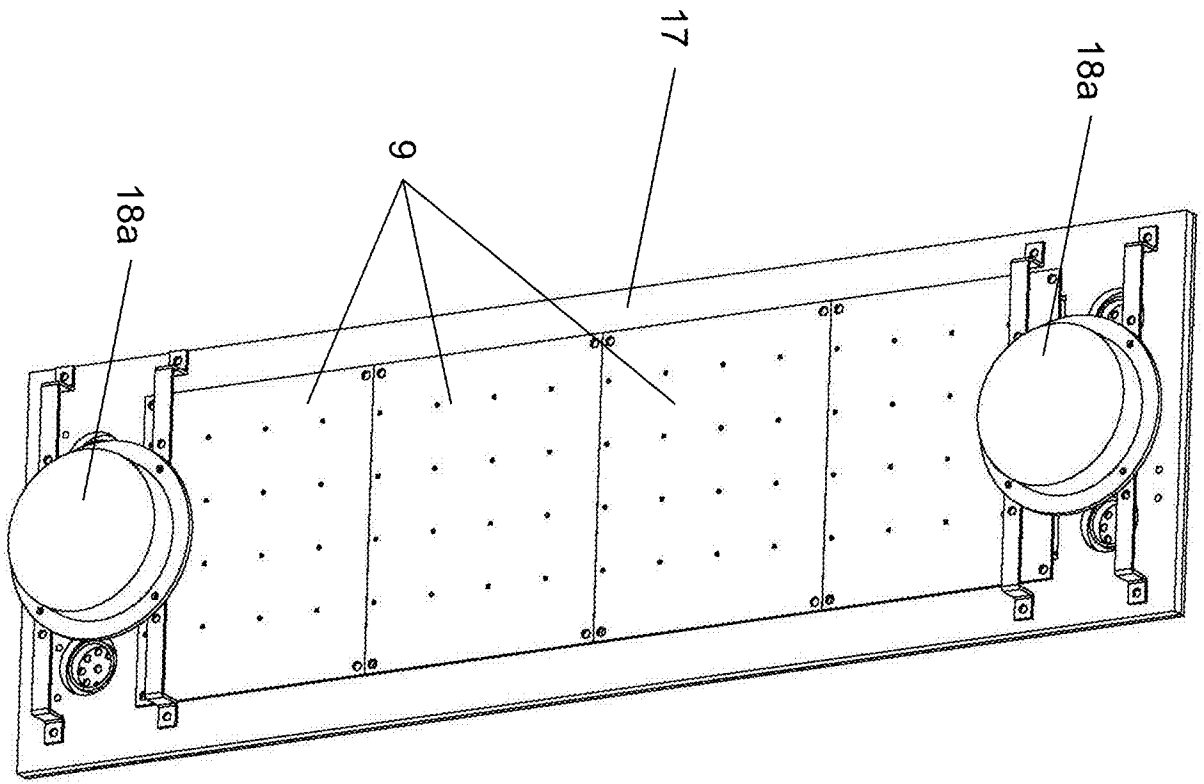
FIG. 11 illustrates a back view of the internal GiantDOTS™ graphics display and speaker assembly.
Figure 12:
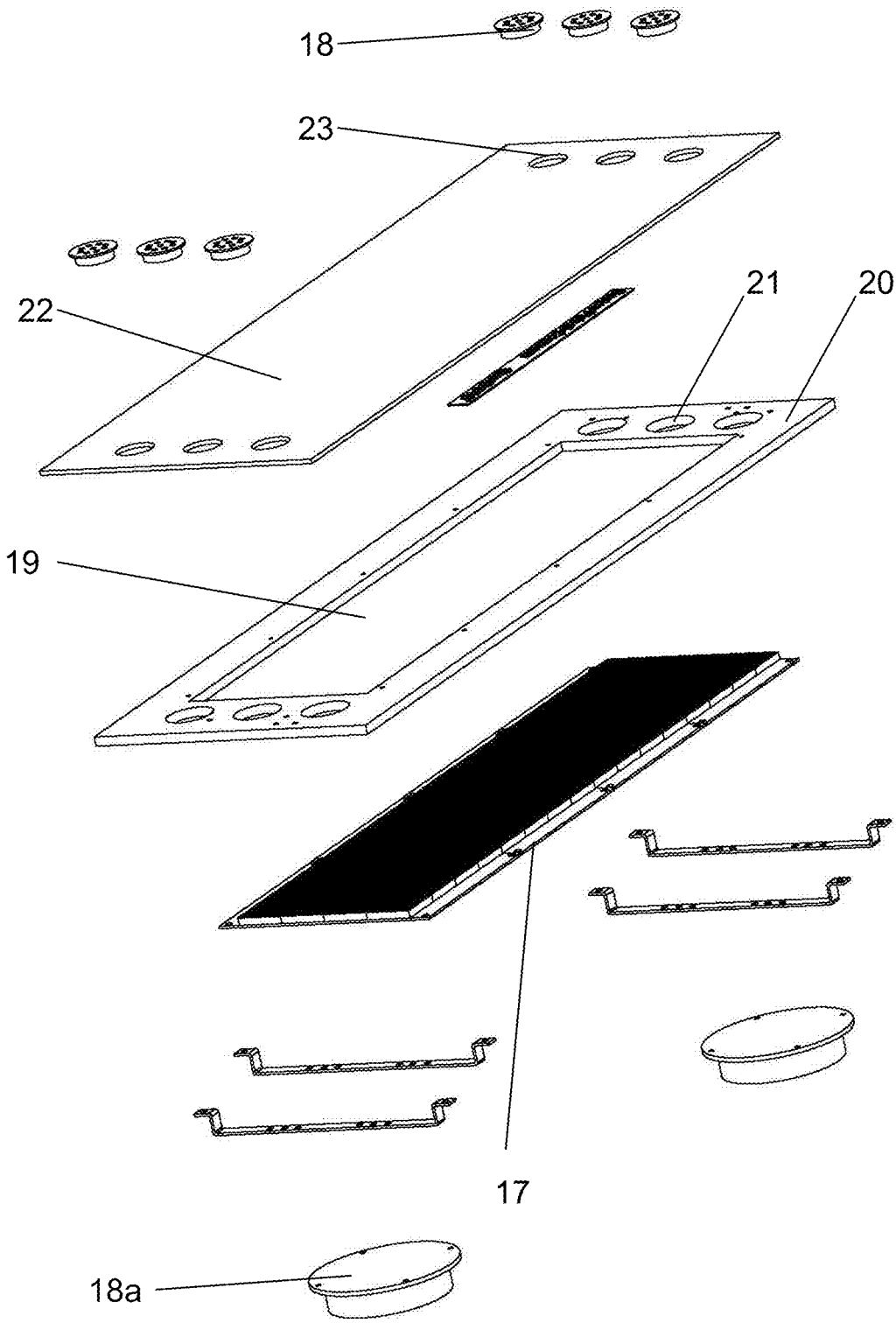
FIG. 12 illustrates an exploded view of the internal GiantDOTS™ graphics display and speaker assembly.

The internal GiantDOTS™ graphics display and speaker assembly 17 is inserted into the backbox 3 of the pinball machine 1 to replace a standard pinball machine internal gas tube display 7. As shown in FIG. 9, an external GiantDOTS™ graphics display assembly 8 may also be placed on top of the pinball machine backbox 3 alongside the internal GiantDOTS™ graphics display and speaker assembly 17 inserted into the backbox 3. The internal GiantDOTS™ graphics display and speaker assembly 17 contains several Light-Emitting Diode (LED) or plasma display modules 6 that project images to a player. In embodiments of the subject invention, display modules 6 are plasma or LED dot matrix printed circuit boards that may have a length of two to forty inches and a width of two to twenty inches. In one embodiment of the subject invention, these display modules 6 may be plasma or LED dot matrix-Eight-inch by Eight-inch printed circuit boards 9. These display modules 6 may each contain One Hundred Twenty-Eight columns and Thirty-Two rows of individual illuminating pixels 10. Since the display modules 6 are composed of LEDs, they may project images in the colors of red, yellow, orange, amber, green, blue and white.

In embodiments of the subject invention, the display modules 6 may contain one to ten printed circuit boards 9 connected by connectors. In one embodiment of the subject invention, the external GiantDOTS™ graphics display and speaker assembly 17 is comprised of four display module printed circuit boards 9 connected by four connectors on each display module 6. Each display module 6 has two connectors on each side. These connectors are used to interconnect the control wiring; power wiring and mechanical attach the display modules 6 together to provide alignment.

The internal GiantDOTS™ graphics display and speaker assembly 17 further contains a control board that controls the operation of display modules 6 and connects the display modules 6 to the game controller of the pinball machine 1. The control board has provisions for several standoffs that align the control board with the display modules 6 to provide a secondary method of mechanical fit between them. Electrical interconnection between the control board and the display modules 6 is established by power interconnect cables and ribbon cables to provide the control signals from the game controller.

The internal GiantDOTS™ graphics display and speaker assembly 17 also contains multiple speakers 18*a* covered by vented hole plugs 18 to project sound signals generated by the game controller. These speakers 18*a* are connected to the control board by power interconnect cables and ribbon cables to provide the control signals from the game controller.

The display modules 6 of the internal GiantDOTS™ graphics display and speaker assembly 17 is contained within a substantially square aperture 19 of a flat panel 20. In one embodiment of the subject invention, this flat panel 20 may be twenty to thirty inches in length. In a further embodiment of the subject invention, the flat panel 20 may be four to ten inches in height. In another embodiment of the subject invention, the flat panel 20 comprises a one piece.

The flat panel 20 of the internal GiantDOTS™ graphics display and speaker assembly 17 further contains speaker apertures 21 for holding two or more game speakers 18*a*. These speaker apertures 21 may have any shape to accommodate the size and shape of the game speakers 18*a*.

The imaging side of the display modules facing the player during game play is covered by an acrylic, or other translucent material, apertured panel 22. This apertured panel 22 contains speaker apertures 23 for holding two or more game speaker 18*a*. These speaker apertures 23 may have any shape to accommodate the size and shape of the game speakers 18*a*. In one embodiment of the subject invention, the apertured panel 22 may be twenty to thirty inches in length. In a further embodiment of the subject invention, the apertured panel 22 may be four to ten inches in height. This apertured panel 22 may be tinted to increase the visual aesthetics of graphic displays during game play.

The many aspects and benefits of the invention are apparent from the detailed description, and thus, it is intended for the following claims to cover such aspects and benefits of the invention, which fall within the scope, and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

What is claimed is:

1. A pinball machine, comprising: a cabinet including a pair of opposing side walls, a front wall and a rear wall, wherein a playfield is mounted within the cabinet, further wherein the playfield supports a rolling ball and a plurality of play features thereon, wherein the playfield and the plurality of play features are covered with a first translucent panel; a substantially vertical backbox on top of the rear wall of the cabinet mounted above the first translucent panel, wherein the backbox comprises a substantially vertical front side facing a user of the pinball machine; an electronics system including a game control unit with means to interface a plurality of input/output elements mounted to the playfield, further wherein the game control unit comprises a software program that monitors game operation and monitors game play; a first dot matrix graphics display assembly mounted in front of the backbox at the bottom of the front side above the first translucent panel of the playfield; the first dot matrix graphics display assembly comprising a first plurality of display modules that display images to a user of the pinball machine and at least one first control board, wherein the first control board comprises a first means for interfacing the first plurality of display modules and a first means to interface the game control unit, further wherein the first plurality of display modules are covered by a second translucent panel; and a power supply and a first means to connect the first dot matrix graphics display assembly to the power supply.

2. The pinball machine of claim 1, further comprising a second dot matrix graphics display assembly externally attached on top of the backbox, the second dot matrix graphics display assembly comprising a second plurality of display modules that display images to a user of the pinball machine and at least one second control board within an enclosure, wherein the second control board comprises a second means for interfacing the second plurality of display modules and a second means to interface the game control unit, further wherein the second plurality of display modules are covered by a third translucent panel; and a second means to connect the second dot matrix graphics display assembly to the power supply.

3. A method of retrofitting a pinball machine, said pinball machine including a cabinet including a pair of opposing side walls, a front wall and a rear wall, wherein a playfield is mounted within the cabinet, wherein the playfield is covered with a first translucent panel; a substantially vertical backbox mounted on top of the rear wall of the cabinet above the first translucent panel, wherein the backbox comprises an internal display assembly covered by a second translucent panel facing a user of the pinball machine; an electronics system including a game control unit with means to interface a plurality of input/output elements mounted to the playfield, further wherein the game control unit comprises a software program that monitors game operation and monitors game play; means to interface the internal display assembly and the game control unit; and a power supply with a means to connect to the internal display assembly; the method comprising the steps of: removing the second translucent panel from the backbox; detaching the internal display assembly from the means to interface the game control unit and the means to connect to the power supply; removing the internal display from the backbox; installing means to externally attach a first external graphics display assembly to the front of the backbox at the bottom of the front side, wherein the first external graphics display assembly comprises a first plurality of display modules and at least one first control board within a first enclosure, wherein the first control board comprises a first means for interfacing the first plurality of display modules, further wherein the first plurality of display modules are covered by a third translucent panel; attaching the means to interface the internal display assembly and the game control unit to the first control board of the first external graphics display; attaching the means to connect to the power supply to the first external graphics display; and attaching the first external graphics display assembly to the front of the backbox at the bottom of the front side above the first translucent panel.

4. The method of claim 3, wherein the step of installing means to externally attach a first external graphics display assembly to the backbox at the bottom of the front side comprises attaching mounting brackets onto a display mounting panel square cutout from which the internal display assembly has been removed from the backbox.

5. The method of claim 3, wherein each of the plurality of display modules comprises plasma dot matrix display modules.

6. The method of claim 3, wherein each of the plurality of display modules comprises LED dot matrix display modules.

7. The method of claim 3, wherein each of the plurality of display modules comprises an 8 inch by 8 inch printed circuit board.

8. The method of claim 3, wherein each of the plurality of display modules comprises 128 columns and 32 rows of individual pixels.

9. The method of claim 3, wherein each of the plurality of display modules displays a color selected from the group consisting of: red, yellow, orange, amber, green, blue and white.

10. The method of claim 3, wherein the brightness of the plurality of display modules is adjustable.

11. The method of claim 3, wherein each of the translucent panels is tinted.

* * * * *